US009975355B2

(12) United States Patent
Pappenberger et al.

(10) Patent No.: US 9,975,355 B2
(45) Date of Patent: May 22, 2018

(54) DRYER FOR AN INKJET PRINTING SYSTEM WITH HALF-WAVE SYMMETRICAL OPERATION

(71) Applicant: Océ Holding B.V., Venlo (NL)

(72) Inventors: Martin Pappenberger, Tuntenhausen (DE); Markus Lege, Steinhoering (DE)

(73) Assignee: Océ Holding B.V., Venlo (NL)

( * ) Notice: Subject to any disclaimer, the term of this patent is extended or adjusted under 35 U.S.C. 154(b) by 0 days. days.

(21) Appl. No.: 15/599,732

(22) Filed: May 19, 2017

(65) Prior Publication Data

US 2017/0334216 A1 Nov. 23, 2017

(30) Foreign Application Priority Data

May 19, 2016 (DE) ..... 10 2016 109 244

(51) Int. Cl.

*B41J 11/00* (2006.01)
*H05B 3/00* (2006.01)
*H05B 1/02* (2006.01)

(52) U.S. Cl.

CPC ..... *B41J 11/002* (2013.01); *H05B 3/00* (2013.01); *H05B 1/02* (2013.01); *H05B 2203/035* (2013.01)

(58) Field of Classification Search

CPC .... B41J 11/002; H05B 3/00; H05B 2203/035; H05B 1/02

See application file for complete search history.

(56) References Cited

U.S. PATENT DOCUMENTS 5,896,154 A * 4/1999 Mitani ..... B41J 2/1404 347/102
2006/0197805 A1* 9/2006 Smith ..... B41J 2/0457 347/56
2012/0188603 A1* 7/2012 Pilsl ..... H04L 12/40006 358/1.15
2012/0206527 A1* 8/2012 Leighton ..... B41J 2/17593 347/16

FOREIGN PATENT DOCUMENTS

DE 4004508 A1 8/1991

* cited by examiner

*Primary Examiner* — Henok Legesse
(74) *Attorney, Agent, or Firm* — Schiff Hardin LLP

(57) ABSTRACT

In a drying system for a printing system, a plurality of dryers can be arranged along a drying route to dry a recording medium. The plurality of dryers can including multiple resistive heating elements configured to dry the recording medium. The dryers can be supplied via two or more supply lines with an alternating current having a sequence of alternating positive and negative half-waves. A controller of the drying system can be coupled to the dryers and can couple the dryers uniformly on average with the at least two supply lines given positive and negative half-waves based on a nominal temperature curve along the drying route. The controller can jointly couple the resistive heating elements of a corresponding dryer with a multiphase supply grid or jointly decouple the resistive heating elements of the dryer with the multiphase supply grid during a half-wave.

16 Claims, 7 Drawing Sheets

DRYER FOR AN INKJET PRINTING SYSTEM WITH HALF-WAVE SYMMETRICAL OPERATION

CROSS REFERENCE TO RELATED APPLICATIONS

This patent application claims priority to German Patent Application No. 10 2016 109244.4, filed May 19, 2016, which is incorporated herein by reference in its entirety.

BACKGROUND

The present disclosure relates to a dryer for an inkjet printing system, and to a corresponding method for drying the print image of an inkjet printing system.

Inkjet printing systems may be used to print to recording media (for example paper). For this, one or more nozzles may be used in order to fire ink droplets onto a recording medium and in order to thus generate a desired print image on the recording medium.

An inkjet printing system may comprise one or more dryers in order to dry the recording medium after application of the print image, and in order to thus fix the applied ink onto the recording medium. An insufficient drying of the recording medium may lead to the situation that the print image is smeared by following processing steps, and/or that components of the inkjet printing system are contaminated by insufficiently dried ink. Furthermore, a degradation of the recording medium and/or of the print image may possibly be caused by the process of drying (in particular by too intensive a drying).

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1A:
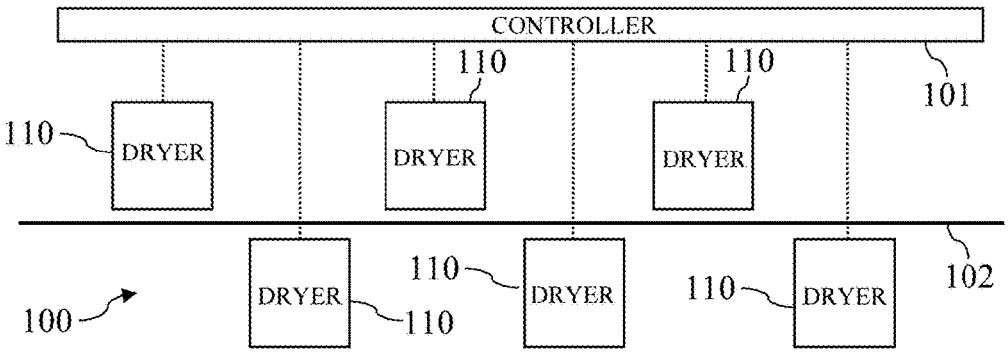
Figure 1B:
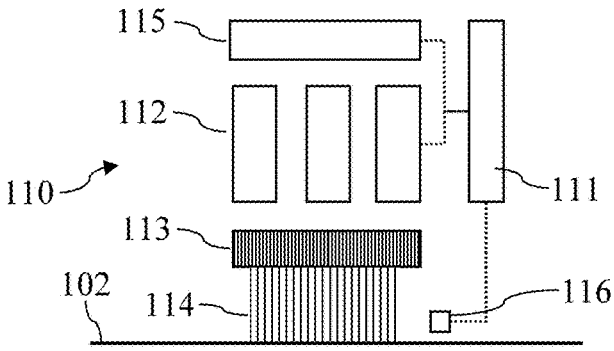
Figure 1C:
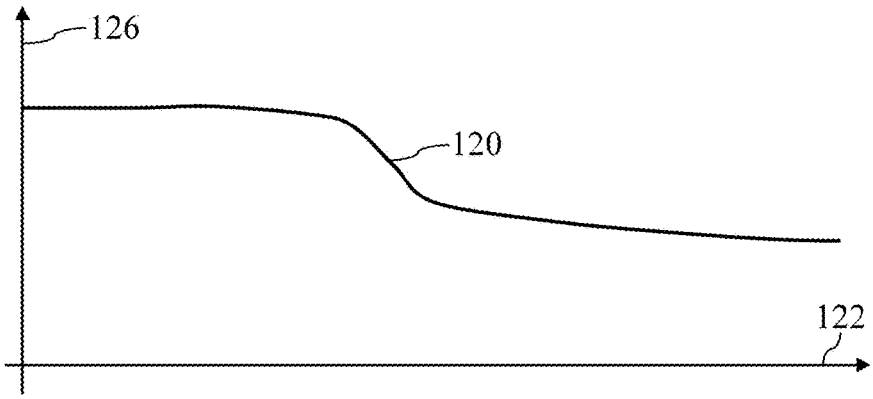
Figure 2A:
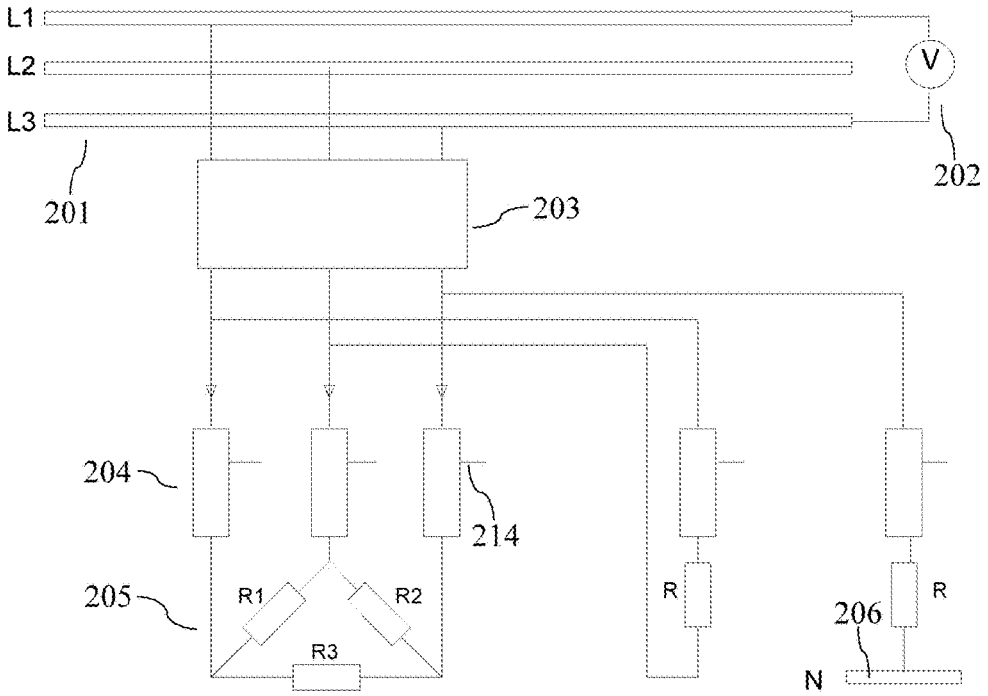
Figure 2B:
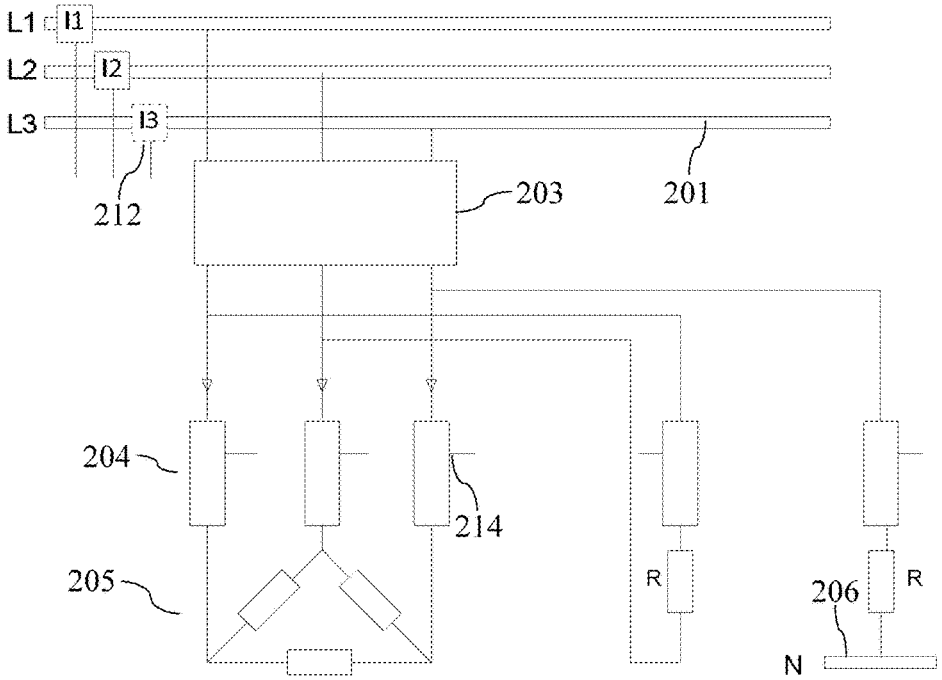
Figure 2C:
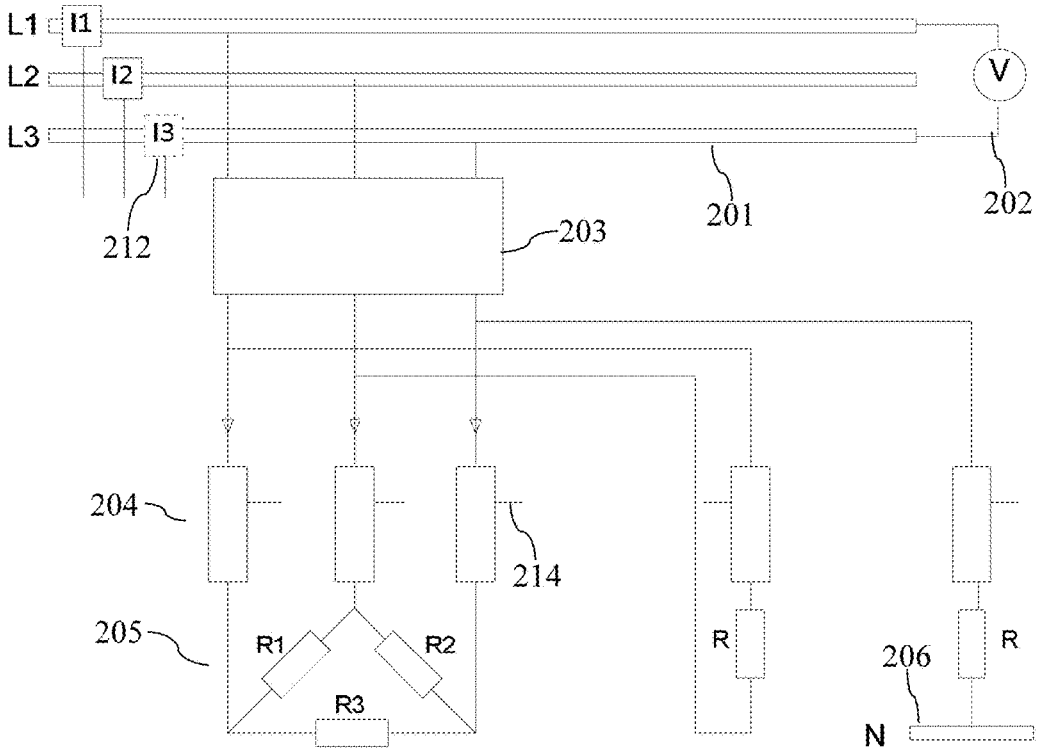
Figure 3A:
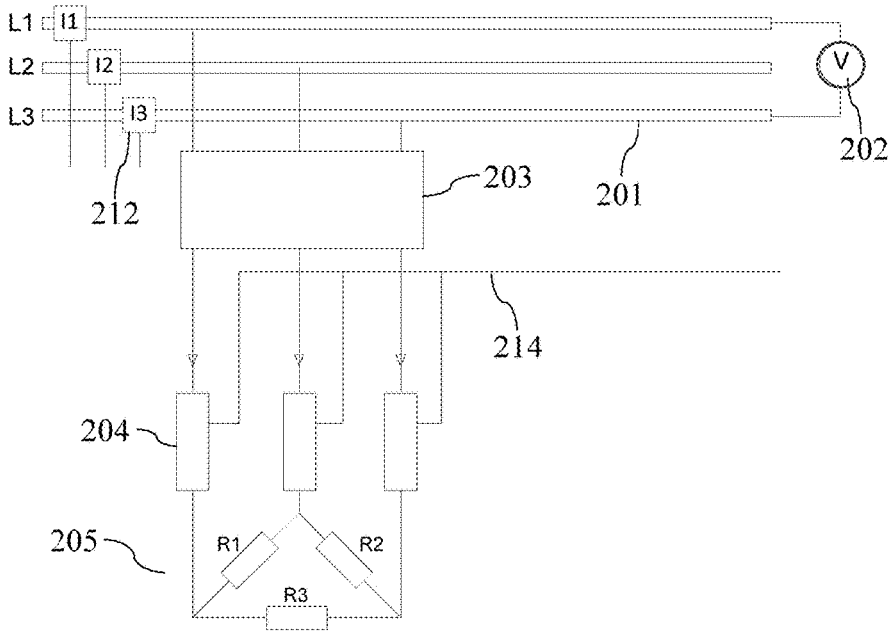
Figure 3B:
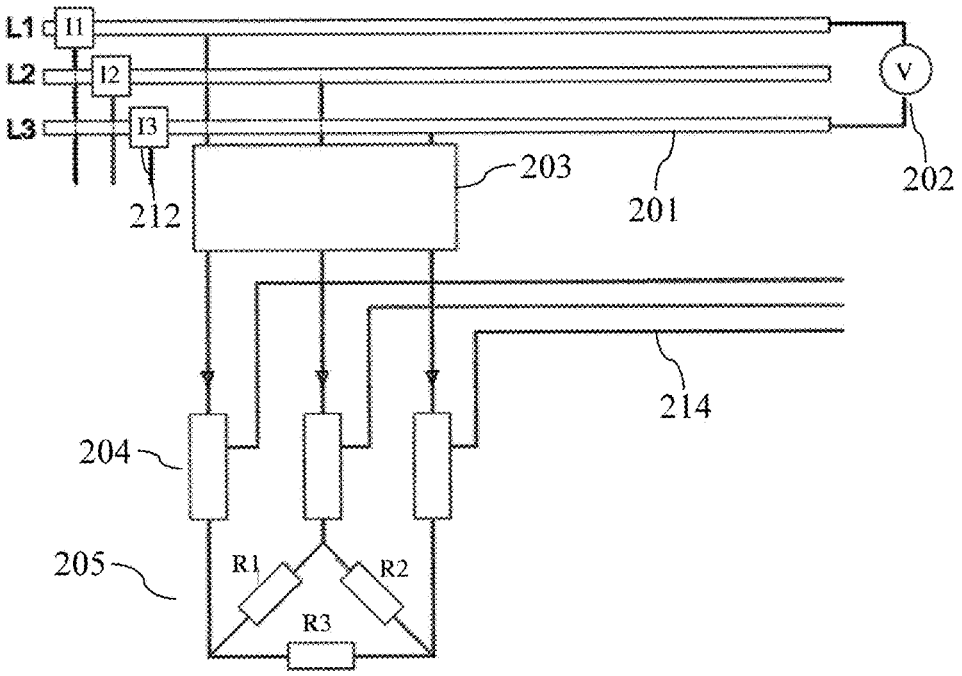
Figure 3C:
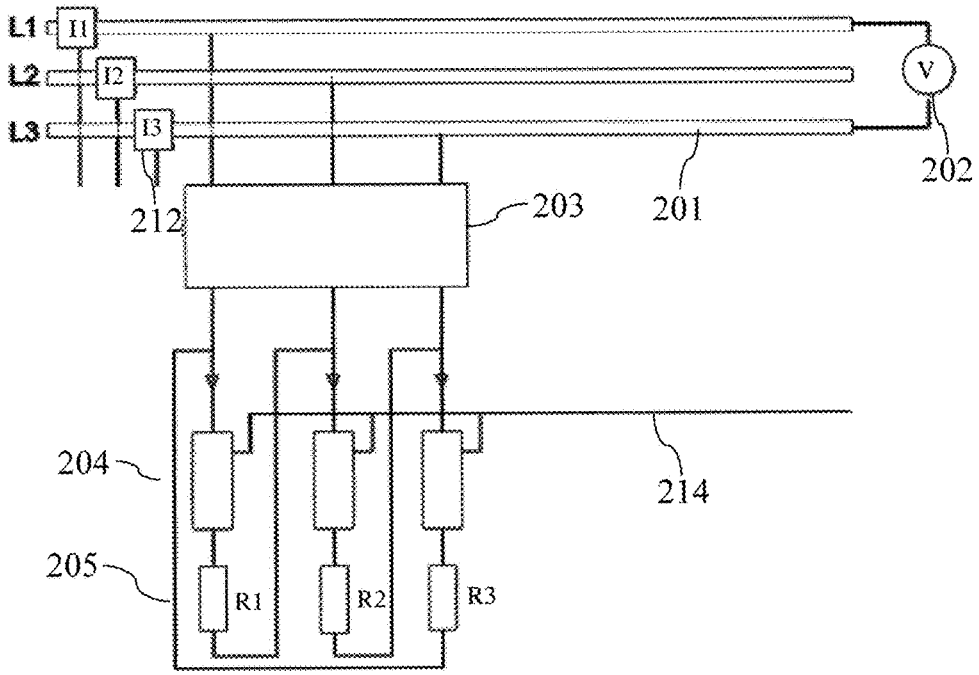
Figure 3D:
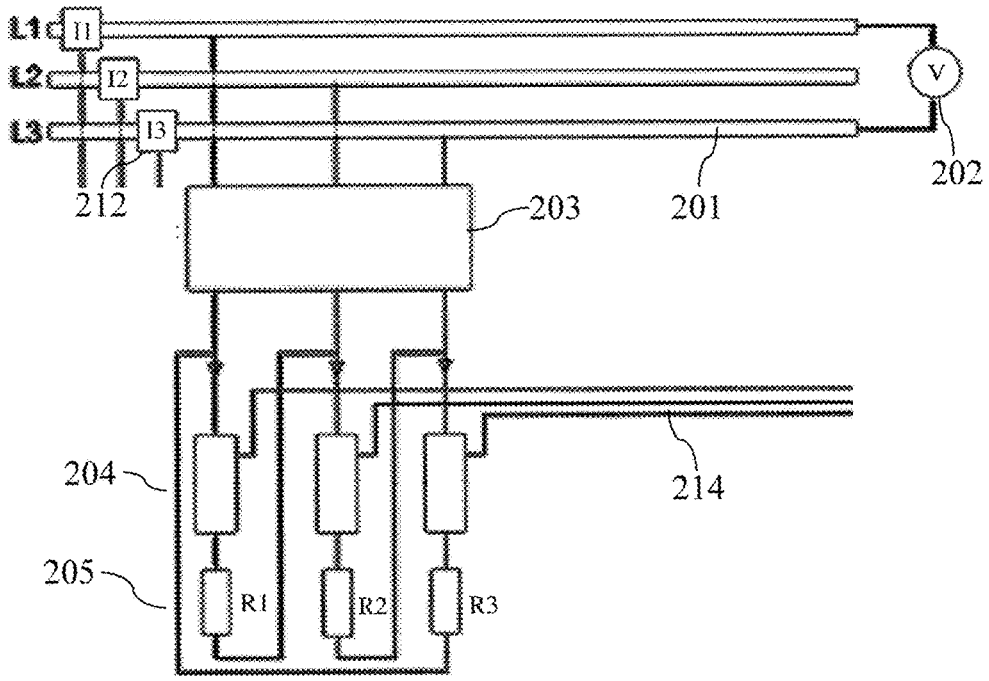
Figure 3E:
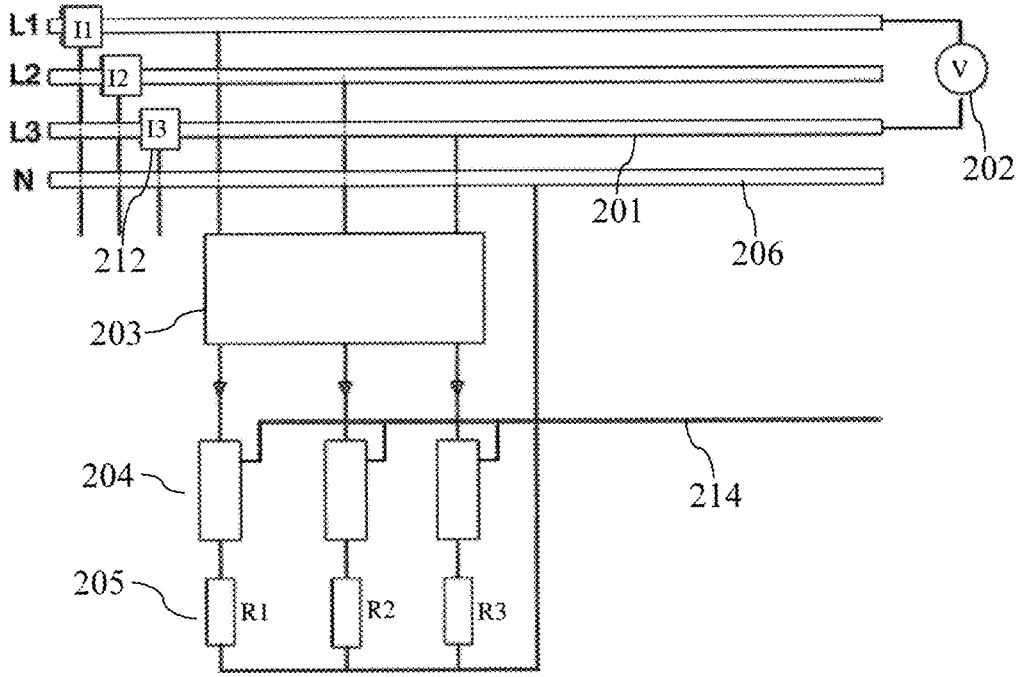
Figure 3F:
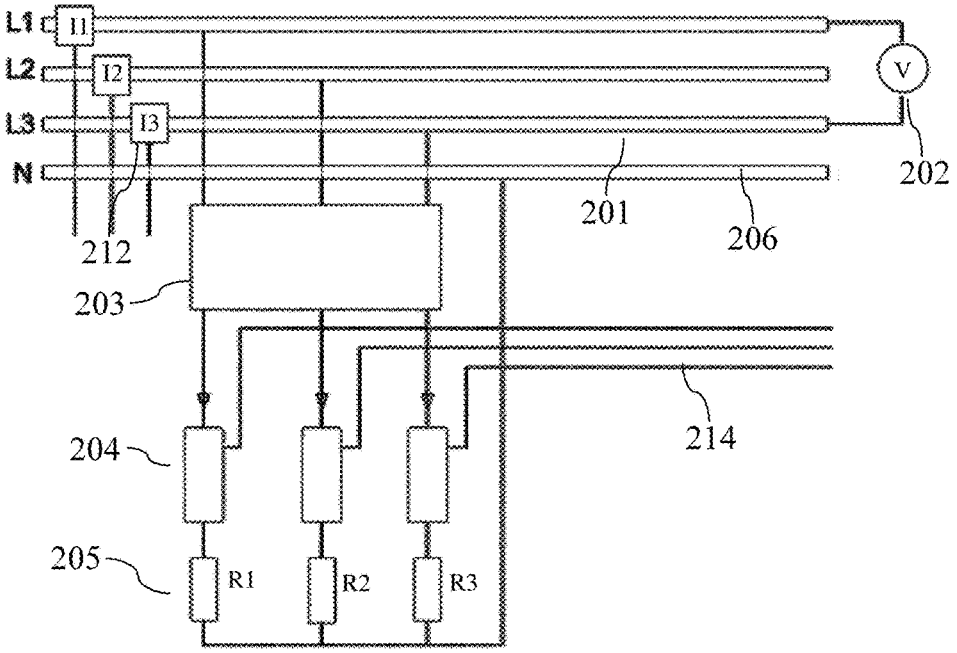
Figure 4A:
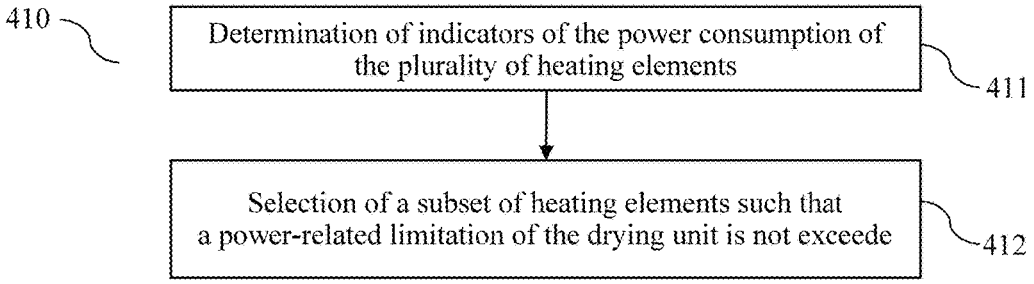
Figure 4B:
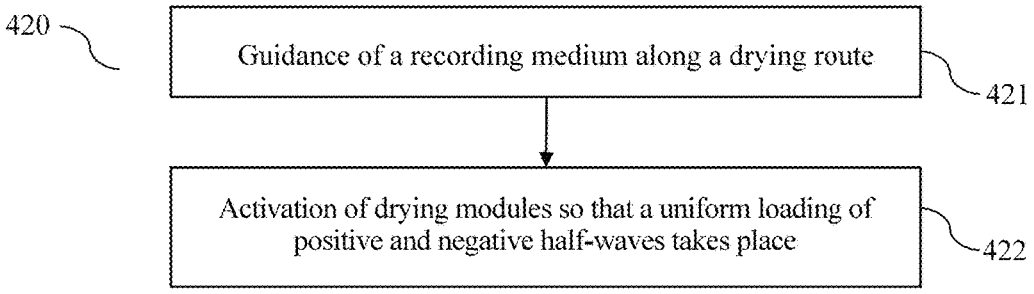
Figure 4C:
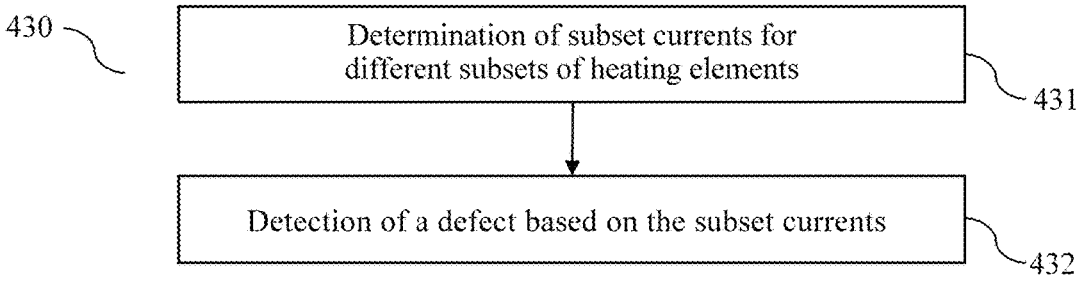
Figure 5:
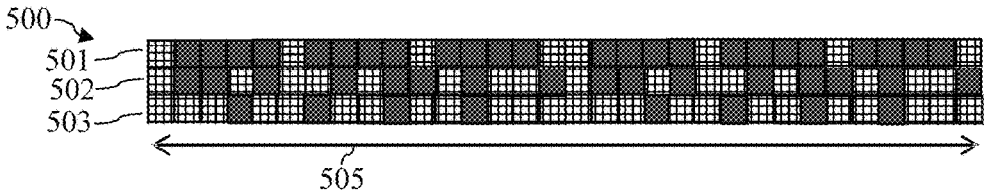

FIG. 1*a* illustrates a block diagram of a drying system for an inkjet printing system according to an exemplary embodiment of the present disclosure;

FIG. 1*b* illustrates a block diagram of a dryer for a drying system according to an exemplary embodiment of the present disclosure;

FIG. 1*c* illustrates a temperature curve along the drying route of a drying system according to an exemplary embodiment of the present disclosure;

FIG. 2*a* illustrates components of a drying system having a voltage measurement meter according to an exemplary embodiment of the present disclosure;

FIG. 2*b* illustrates components of a drying system having multiple current measurement meters according to an exemplary embodiment of the present disclosure;

FIG. 2*c* illustrates components of a drying system having a voltage measurement meter and multiple current measurement meters according to an exemplary embodiment of the present disclosure;

FIG. 3*a* illustrates components of a drying system having a joint activation of power switches according to an exemplary embodiment of the present disclosure;

FIG. 3*b* illustrates components of a drying system having an individual activation of power switches according to an exemplary embodiment of the present disclosure;

FIG. 3*c* illustrates components of a drying system having a joint activation of power switches according to an exemplary embodiment of the present disclosure;

FIG. 3*d* illustrates components of a drying system having an individual activation of power switches according to an exemplary embodiment of the present disclosure;

FIG. 3*e* illustrates components of a drying system having a joint activation of power switches according to an exemplary embodiment of the present disclosure;

FIG. 3*f* illustrates components of a drying system having an individual activation of power switches according to an exemplary embodiment of the present disclosure;

FIG. 4*a* illustrates a workflow diagram of a method for drying a recording medium according to an exemplary embodiment of the present disclosure;

FIG. 4*b* illustrates a workflow diagram of a method for drying a recording medium according to an exemplary embodiment of the present disclosure;

FIG. 4*c* illustrates a workflow diagram of a method for detection of a defect of a dryer according to an exemplary embodiment of the present disclosure; and FIG. 5 illustrates look-up tables with activation patterns according to an exemplary embodiment of the present disclosure.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

A dryer can comprises one or more electrical heating elements that are supplied with electrical power by an electrical supply grid. Tolerances of the mains voltage provided by the supply grid may thereby lead to tolerances of the heating capability of the one or more heating elements, and therefore to changes in the degree of drying of a recording medium.

Exemplary embodiments of the present disclosure are directed to the technical object of enabling a reliable drying of the print image of an inkjet printing system with reduced loading of an electrical supply grid.

According to one aspect, a dryer for a printing system is described. In an exemplary embodiment, the dryer comprises a plurality of drying modules that are arranged along a drying route in order to dry a recording medium upon passage through the drying route. The plurality of drying modules is thereby supplied, via at least two supply lines, with an alternating current having a sequence of alternating positive and negative half-waves. The dryer additionally comprises a controller that is configured to couple the plurality of drying modules uniformly, on average, with the at least two supply lines given positive and negative half-waves, depending on a nominal temperature curve along the drying route. Given a precise adjustment (in particular regulation) of the drying temperatures, effects on a supply grid may thus be reduced.

According to a further aspect, a method corresponding to the aforementioned dryer is described.

According to a further aspect, a software (SW) program is described. The SW program may be configured to be executed by a processor, thereby executing the method according to one or more exemplary embodiments of the present disclosure.

According to a further aspect, a storage medium is described. The storage medium may include a SW program which is configured to be executed by a processor, thereby executing the method according to one or more exemplary embodiments of the present disclosure.

It is to be noted that the method, devices and systems described in this document may be used both alone and in combination with other methods, devices and systems described in the present disclosure. Furthermore, any aspects of the method, device and systems described in the disclosure may be combined with one another in numerous ways.

As presented above, the present disclosure is directed to the reliably and gently drying of the print image of an inkjet printing system, especially even given varying mains voltages. The disclosure additionally is directed to the reduction of effects on a supply grid due to a dryer. Furthermore, the disclosure is directed to the reliable detection of defects in a dryer.

Given an inkjet printing system, in particular given a printing system designed for printing to a web-shaped recording medium (also designated as a "continuous feed"), the recording medium is unspooled from a roll (the take-off), for example, and then supplied to the print group of the printing system. Via the print group, a print image is applied onto the recording medium and the printed recording medium may be processed further after fixing / drying of the print image (for example be taken up again on an additional roll (the take-up) or be supplied, cut or turned, to an additional print group). The recording medium may be produced from paper, paperboard, cardboard, metal, plastic and/or other suitable and printable materials.

In an exemplary embodiment, the print group of the printing system may comprise multiple print bars that, for example, may be used for printing with inks of different colors (for example black, cyan, magenta, yellow etc.). A print bar comprises one or more print heads. Each print head comprises one or more nozzles, wherein each nozzle is configured to fire ink droplets onto the recording medium. A respective row (line) may be printed by means of the nozzles of a print head onto the recording medium, transversal to the transport direction of the recording medium. The printing system is configured to activate the individual nozzles of the individual print heads in order to apply a print image onto the recording medium depending on print data.

In an exemplary embodiment, the printing system additionally comprises a drying system 100 (see FIG. 1*a*) that is configured to dry the recording medium 102 after application of the ink by the one or more print bars, and therefore to fix the applied print image onto the recording medium 102. In an exemplary embodiment, the drying system 100 may be controlled by a controller 101 to dry the recording medium 102. For example, the drying may take place based on the quantity of applied ink and/or depending on a type of the recording medium 102. In an exemplary embodiment, the controller 101 includes processor circuitry that is configured to perform one or more functions and/or operations of the controller 101, including, for example, controlling the operation of the drying system 100 (e.g., controlling the drying of the recording medium 102).

In an exemplary embodiment, the drying system 100 depicted in FIG. 1*a* comprises multiple dryers 110 that are arranged along a drying route on one or both sides of the (web-shaped) recording medium 102 and that are respectively configured to blow a gaseous drying medium (typically heated air) onto the surface of the recording medium 102. The print image on the recording medium 102 may thus be dried in a gentle and reliable manner along the drying route of the drying system 100.

FIG. 1*b* shows a block diagram with examples of components of a dryer 110 according to an exemplary embodiment. In an exemplary embodiment, the dryer 110 comprises a blower 115 with which a gaseous medium may be directed past one or more heating elements 112. The drying medium 114 heated by the heating elements 112 is then blown via one or more openings or nozzles 113 onto the surface of the recording medium 102. The delivery rate of the blower 115 and/or the heating capacity of the one or more heating elements 112 may be controlled or regulated via a controller 111 (the controller 111 may possibly be part of the controller 101 of the drying system 100, or a separate controller, or a combination of both). The temperature in the environment of the recording medium 102 may in particular be detected using a temperature sensor 116. In an exemplary embodiment, the controller 111 is configured to control or regulate the blower 115 and/or the one or more heating elements 112 depending on sensor data of the temperature sensor 116. For example, a specific temperature may thus be set in the environment of the recording medium 102. In an exemplary embodiment, the controller 111 includes processor circuitry that is configured to perform one or more functions and/or operations of the controller 111, including, for example, regulating or controlling the operation of blower 115 and/or the heating capacity of one or more heating elements 112 (e.g., based on the sensor data).

FIG. 1*c* shows an example of a curve 120 of the temperature 126 in the environment of the recording medium 102 along the drying route 122 of the drying system 100 according to an exemplary embodiment. For example, via the plurality of dryers 110 it may be effected that the recording medium 102 is exposed to a drying medium 114 having a relatively high temperature 126 at the start of the drying route 122, and that the temperature 126 is reduced along the drying route 122. Via adjustment of a specific (nominal) temperature curve 120, a reliable drying of the print image may be achieved (for example depending on properties of the recording medium 102 and/or on properties or quantities of applied ink). A (nominal) drying curve 120 may be determined experimentally in advance and be adjusted by the controller 101 or the control modules 111.

Via the use of dryers 110 that blow a heated, gaseous drying medium 114 onto a recording medium 102, a reliable drying may be produced in a gentle manner. Damage to the print image may in particular thereby be avoided even given duplex printing.

A reliable drying typically requires a precise adjustment of the temperature curve 120 along the drying route 122, which in turn requires a precise adjustment of the heating power of the heating elements 122 of the individual dryers 110. In an exemplary embodiment, the heating elements 112 are resistive heating elements 112 (e.g. heating resistors). The resistive heating elements 112 can be configured such that their heating power depends on the mains voltage with which the heating elements 112 are supplied. Fluctuations of the mains voltage may thereby lead to fluctuations of the heating power.

For example, the mains voltage U may fluctuate in a range of +/−10%. Furthermore, the resistance R of heating resistors may fluctuate (for example by +/−5%). According to $P=U^2/R$, this has substantial effects on the heating power P. A drying system 100 may be designed such that the drying system 100 may produce at least the (nominal) heating power $P_{min}$ to be produced given maximum possible resistance values $P_{min}$ and minimum possible mains voltage $U_{min}$. However, this may lead to the situation that a relatively high maximum current $I_{max}=U_{max}/R_{min}$ for which the components of the drying system 100 (and in particular a mains connection of the drying system 100) are to be designed flows given maximum possible mains voltage $U_{max}$ and given minimum possible resistance $R_{min}$. This is linked with relatively high costs. In the following, measures are described via which fluctuations of the mains voltage U may be taken into account cost-effectively.

FIG. 2*a* shows examples of components of a drying system 100 according to an exemplary embodiment. In the depicted example, the drying system 100 is supplied via a three-phase supply grid with the phase lines L1, L2, L3 (reference character 201) and the neutral line N (reference character 206). FIG. 2*a* additionally shows heating resistors 205 (as examples of heating elements 112) of a dryer 110 that is connected to the supply grid via one or more phase lines L1, L2, L3 or the neutral line N. In an exemplary embodiment, a dryer 110 may comprise three heating resistors R1, R2, R3 (FIG. 2*a,* left variant), but is not limited thereto. Alternatively, a dryer 110 may comprise one or more heating resistors R that are arranged between two phases (FIG. 2*b,* middle variant) or that are arranged between a phase L and N (FIG. 2*c,* right variant).

In an exemplary embodiment, a heating resistor 205 may be activated or deactivated by one or more power circuit 204. For example, in FIG. 2*a* the heating resistor R1 and the series circuit made up of R2 and R3 may be activated by two power switches 204. The power switches 204 may be opened or closed via one or more control lines 214. The drying system 100 may additionally comprise power protection switches 203 that are configured to decouple the one or more heating resistors 205 from the phase line L1, L2, L3 given an overcurrent on a phase line L1, L2, L3.

The drying system 100 in FIG. 2 can include a voltage measurement meter 202 that is configured to measure the mains voltage U of at least one phase (for example L1) relative to another phase (for example L3 or N). Assuming symmetrical mains, the mains voltages of the other phases L2, L3 may be concluded from this.

Furthermore, the resistance values R of the individual heating resistors 205 may be measured in advance and stored (for example in a memory of the printing system or of the drying system 100). The heating power $P=U^2/R$ of each heating resistor 205 may then be determined on the basis of the measured mains voltage U and on the basis of the stored resistance values. Furthermore, the current I may be calculated via the individual heating resistors 205. The controller 101 of the drying system 100 may be configured to activate the heating resistors (also designated as resistive loads) 205 such that at no point in time does the cumulative total current through the heating resistors 205 exceed a limit current $I_{Limit}$. The limit current $I_{Limit}$ may thereby be chosen to be smaller than the maximum current $I_{max}$ that would result if all heating resistors 205 of the drying system 100 were activated given maximum possible mains voltage $U_{max}$. Via storage of the actual resistance values, and via the detection of the mains voltage, a boundary of the accumulated total current or a boundary of the cumulative power consumption at a specific point in time may thus be efficiently produced so that no overdimensioning of the mains connection of the drying system 100 is required.

FIG. 2*b* shows a drying system 100 according to an exemplary embodiment having (at least two) current measurement meters 212 that are configured to detect the total current $I_1$, $I_2$, $I_3$ at a respective phase line L1, L2, L3. In particular, the current of the resistive load 205 on at least two phases may be measured. The current on the respective third phase may be determined on the basis of the currents of the two other phases.

In an exemplary embodiment, upon activation of the drying system 100 or of a dryer 110, all resistive loads 205 may be activated in sequence, and the effective current may be measured per load 205 (by means of the current measurement meters 212). Depending on the determined current values per load 205, at a specific point in time one or more loads 205 may then be selected so that the cumulative total current does not exceed the limit current $I_{Limit}$. The activation of the one or more loads 205 may thereby be monitored via a total current measurement by means of the current measurement meters 212. Upon exceeding the established limit current $I_{Limit}$, all loads 205 may possibly be deactivated by means of the safety circuit 203.

FIG. 2*c* shows a drying system 100 according to an exemplary embodiment having one or more voltage measurement meters 202 and two or more current measurement meters 212. Given a combination of current measurement and voltage measurement, the measurement of the resistance of the resistive load 205 may possibly be omitted.

In an exemplary embodiment, the maximum allowable current consumption may be adjusted via the measurement of the mains voltage and/or of the total current. Given relatively strong fluctuations of the mains voltage and given a mains connection of limited design, the required power of the resistive load 205 may thus be ensured over the entire usage range of the drying system 100. In particular, no compromise with a relatively large mains connection or with a reduced performance capability of the drying system 100 is required for this. The reliable current consumption of the drying system 100 may be parameterized, and therefore optimized, depending on the present electrical infrastructure or the respective requirements. The current consumption of the drying system 100 is monitored and/or regulated via the described power management, such that an overload is prevented.

A drying system 100 is thus described for a printing system, in particular for an inkjet printing system. Furthermore, a printing system having a drying system 100 is described. The drying system 100 may comprise any of the features and/or components described in the present disclosure.

In an exemplary embodiment, the drying system 100 comprises a plurality of resistive heating elements 112, 205 (in particular heating resistors) that are configured to generate thermal energy to dry a recording medium 102. The plurality of resistive heating elements 112, 205 may thereby be supplied with electrical power via at least two supply lines 201, 206 (in particular via one or more phase powers 201 and/or via a neutral line 206) of a multiphase supply grid).

In an exemplary embodiment, the drying system 100 comprises switching elements 204 that are configured to couple different subsets of the plurality of resistive heating elements 112, 205 with the supply lines 201, 206 (and therefore to couple the respective subset of heating elements 112, 205 with electrical power), whereby thermal energy for drying a recording medium 102 is generated in turn by the heating elements 112, 205.

In an exemplary embodiment, the drying system 100 additionally comprises controller 101 that is configured to determine indicators of the power consumption of the individual resistive heating elements 112, 205 and/or the power consumption of the individual resistive heating elements 112, 205. An indicator for the power consumption of a resistive heating element 112, 205 may comprise: an ohmic resistance of the heating element 112, 205 (which has been determined in advance and stored in a memory of the drying system 100, for example); a voltage applied to the supply lines 201, 206 (that is detected with a voltage measurement meter 202, for example); a current flowing across one or more of the supply lines 201, 206 (which is detected with one or more current measurement meters 212, for example), and/or one or more other power consumption indicators as would be understood by one of ordinary skill in the art.

In an exemplary embodiment, the controller 101 is additionally configured to select a subset of heating elements 112, 205 (and to couple with the at least two supply lines 201, 206 for the activation of the subset of heating elements 112, 205) based on the indicators of the power consumption of the individual resistive heating elements 112, 205, such that a power-related limitation of the drying system 100 is not exceeded. A (possibly overdimensioned) drying system 100 may thus be reliably used in a limited supply grid. In particular, the (possibly overdimensioned) drying system 100 may be connected to a (possibly current- and/or power-limited) supply line. The costs for the operation (and in particular for the connection) of a drying system 100 may thus be reduced.

The controller 101 may be configured to access a memory in order to determine ohmic resistances (i.e. resistance values) of the plurality of resistive heating elements 112, 205. Furthermore, the drying system 100 may comprise a voltage measurement meter 202 that is configured to determine a voltage applied to the supply lines 201, 206. The controller 101 may then determine the indicator of the power consumption for a heating element 112, 205 on the basis of the ohmic resistance for the heating element 112, 205 and on the basis of the voltage (in particular on the basis of $P=U^2/R$). A reliable and efficient power limit is enabled via the provision of a voltage measurement meter.

In an exemplary embodiment, the drying system 100 includes at least one (typically two or more) current measurement meter 212 that is configured to detect current flowing over one or more of the supply lines 201, 206. In an exemplary embodiment, the controller 101 may be configured to activate the switching elements 204 in order to couple (and therefore to activate) different (possibly sequential) subsets of the plurality of resistive heating elements 112, 205 with the supply lines 201, 206, and in order to thereby determine the respective subset current by means of the current measurement meter 212, via the different subsets of the plurality of resistive heating elements 112, 205. The controller 101 may additionally be configured to determine the indicators for the power consumption of the individual heating elements 112, 205 on the basis of the subset currents over the different subsets of the plurality of resistive heating elements 112, 205. In particular, subset currents for the different heating elements 112, 205 or subsets of heating elements 112, 205 may be stored in a memory of the drying system 100. The controller 100 may then access the stored subset currents during the operation in order to comply with the power-related limitation of the drying system 100 (in particular an allowable limit current $I_{Limit}$). A reliable and efficient power limit is enabled via the provision of at least one current measurement meter.

As presented above, a voltage applied to the supply lines 201, 206 may typically vary between a minimum voltage and a maximum voltage (for example depending on the stability of the supply grid). Alternatively or additionally, the ohmic resistance of a heating element 112, 205 may typically vary between a minimum resistance and a maximum resistance (due to manufacturing tolerances). For this, the drying system 100 may be designed to produce a rated power to dry a recording medium 102 (with which typical recording media 102, typical ink quantities etc. may be dried, for example). The plurality of heating elements 112, 205 of the drying system 100 may be designed to produce the rated power given minimum voltage at the supply lines 201, 206 and given maximum resistance of the heating elements 112, 205. In other words, the drying system 100 may be dimensioned for "worst case" conditions. Nevertheless, a power-related limitation of the drying system 100 (in particular with regard to a connection to the supply grid) may be complied with at any point in time via the activation of subsets of heating elements 112, 205.

The drying system 100 may (as depicted in FIG. 1*a*) comprise multiple dryers 110 that are arranged along a drying route 122 in order to dry the recording medium 102 upon traversal of the drying route 122. Each of the dryers 110 may thereby comprise one or more of the plurality of heating elements 112, 205.

In an exemplary embodiment, the controller 101 is configured to select the subset of heating elements 112, 205 based on a nominal temperature curve 120 along the drying route 122. In particular, the nominal temperature curve 120 may thereby be adjusted via activation of subsets of heating elements 112, 205. A reliable drying of a recording medium 102 may thus be produced.

In an exemplary embodiment, the controller 101 is configured to determine a maximum allowable number of heating elements 112, 205 that may be activated simultaneously, wherein the maximum allowable number of heating elements 112, 205 depends on the power-related limitation. The subset of heating elements 112, 205 may then be determined such that the maximum allowable number of heating elements 112, 205 is exceeded at no point in time. The power-related limit may be efficiently complied with via the determination of a maximum allowable number of activated heating elements 112, 205.

The controller 101 may be configured to determine degrees of activation for the individual dryers 110 for an upcoming planning time period 505 (see FIG. 5), depending on the nominal temperature curve 120. The activation degree of a dryer 110 thereby indicates how long the one or more heating elements 112, 205 of the dryer 110 should be activated in the upcoming planning time period 505. The subset of heating elements 112, 205 may then be selected such that the activation degrees of the individual dryers 110 are fulfilled in the upcoming planning time period 505. A reliable regulation of the nominal temperature curve 120, and an efficient monitoring of the power-related limit, may thus be enabled.

In an exemplary embodiment, as shown in FIG. lb, a dryer 110 may comprise a blower 115 that is configured to blow a gaseous medium (also designated as a drying medium) past the one or more heating elements 112, 205 of the dryer 110 in the direction of the recording medium 102. A gentle drying of a recording medium 102 may thus be produced.

FIG. 4*a* shows a workflow diagram of a method 410 to dry a recording medium 102 according to an exemplary embodiment. The method 410 may include features of other methods 420, 430 described herein. In an exemplary embodiment, the drying takes place using a plurality of resistive heating elements 112, 205 that are configured to generate thermal energy to dry the recording medium 102, wherein the plurality of resistive heating elements 112, 205 is supplied with electrical power via at least two supply lines 201, 206.

In an exemplary embodiment, the method 410 includes the determination 411 of indicators of the power consumption of the individual resistive heating elements 112, 205. Moreover, the method 410 includes the selection 412 (or the selective activation) of a subset of heating elements 112, 205 on the basis of the indicators of the power consumption of the individual resistive heating elements 112, 205, such that a power-related limitation of the drying system 100 is not exceeded.

In an exemplary embodiment, the drying system 100 with multiple heating elements 112, 205 may thereby be designed for an undervoltage case. During operation, the concrete power consumption of the heating elements 112, 205 may be detected and the number of activated heating elements 112, 205 may be limited in order to comply with a power-related limitation of the drying system 100.

As presented above, resistive heating elements 112, 205 may in particular be supplied with mains voltage (phase—phase) at higher power. The resulting power of a resistive heating element 112, 205 is thereby dependent on the mains voltage U and the resistance R of the heating element 112, 205. Tolerances of these two variables affect the power inversely proportionally (resistance) or quadratically (mains voltage). Given a half-wave or full-wave control, the current I=U/R related flows through a heating element 112, 205 during a half-wave or during a full wave. This current value cannot be influenced without using a complicated control (for example without using a sinusoidal regulator).

If a drying route 122 for a recording medium 102 is realized with resistive heating elements 112, 205, a relatively large power difference may thus result between a lower and upper tolerance limit. Depending on the selection of the resistance values, this may lead to a lower drying power given undervoltage or to a power excess given overvoltage.

As presented above, using a voltage measurement meter 202 the mains voltage of at least one phase 201 may be measured against another phase 201 or against N 206. The total current of the resistive heating elements 112, 205 may be measured at least at two phases using current measurement meters 212. The heating elements (meaning the resistive loads) 112, 205 may be designed so that a specific nominal drying power of the drying system 100 is available given undervoltage $U_{min}$ and maximum resistance $R_{max}$ (including tolerance). More heating power is thus typically available than is required for printer functionality and/or than may be simultaneously demanded via the supply grid (for example use of a mains connection of limited design).

So that the power connection is not overloaded, via selection of the simultaneously activated heating elements 112, 205 it may be ensured that the maximum allowable input current $I_{Limit}$ is not exceeded. This limitation of the input current of the drying system 100 is thereby to be satisfied within each half-wave.

For example, via the current measurement of each individual heating element 112, 205, the number of heating elements 112, 205 that may be activated simultaneously may be determined. So that the desired temperature 126 is achieved at the entire drying route 122, it may be ensured by means of suitable activation (for example via the use of lookup tables, LUT) that the different dryers 110 (and the corresponding route segments along the drying route 122) are switched on or off according to their respective power requirements. The necessary drying power may thereby typically be produced more quickly by the drying system 100 due to the existing increased power of the drying system 100. In particular, via a targeted activation of individual heating elements 112, 205 in the different dryers 110 it may be ensured that the entire drying route 122 may be heated according to a target temperature curve 120 even given a reduced number of simultaneously activated heating elements 112, 205.

FIGS. 3*a* through 3*f* show different connection possibilities of three respective heating elements 112, 205 in a dryer 110 according to exemplary embodiments. FIGS. 3*a*, 3*c* and 3*e* thereby shown dryers 110 in which all three heating elements 112, 205 may be activated or deactivated via a common control line 214. It may thus be effectively achieved that the three-phases L1, L2, L3 are loaded symmetrically. FIGS. 3*b*, 3*d* and 3*f* show dryers 110 in which the individual power switches 204 may be opened or closed via individual control lines 214. The heating power of a dryer 110 may thus be increased or reduced in stages.

In an exemplary embodiment, to avoid asymmetries in the supply grid, one or more of the following conditions may be placed on the activation of the individual heating elements 112, 205:

- The half-waves in which power is drawn from the supply grid should be allocated symmetrically to positive and negative half-waves.
- The three-phases of a three-phase supply grid should be loaded symmetrically.

Furthermore, via the selection of simultaneously activated heating elements 112, 205 it should be ensured that the total current that flows during a half-wave does not exceed the maximum allowable total current $I_{Limit}$.

In one or more exemplary embodiments, it may be assumed that the drying system 100 comprises Q dryers 110 having a respective triplet of heating elements 112, 205, wherein each triplet symmetrically loads the three-phases L1, L2, L3. Via an activation or deactivation of all heating elements 112, 205 of a dryer 110, it may thus be ensured that the three-phases of a three-phase supply grid are loaded uniformly.

In an exemplary embodiment, each dryer 110 includes a regulator (for example as part of the controller 111 and/or as part of the controller 101) that is configured to regulate the temperature $T_{REAL}$ in the environment of the dryer 110 to a defined nominal temperature $T_{NOMINAL}$. The nominal temperature $T_{NOMINAL}$ may thereby be predetermined by a nominal temperature curve 120 along the drying route 122. The regulator may determine a control error $\Delta=T_{NOMINAL}-T_{REAL}$ at a sampling point in time $t_0$. Furthermore, the regulator may determine a degree of activation p of the heating elements 112, 205 for an upcoming planning time period $(t_1-t_0)$ up the next sampling point in time $t_1$. The activation degree p thereby indicates what proportion of the upcoming time period $(t_1-t_0)$ the heating elements 112, 205 must be activated in order to regulate the temperature. In particular, the activation degree p may indicate the number of half-waves in which the heating elements 112, 205 must be activated for the regulation of the temperature. The activation degree p may assume values between 0 (or 0%) and 1 (or 100%), for example. In an exemplary embodiment, the regulator includes processor circuitry configured to perform one or more functions and/or operations of the regulator.

Activation degrees $p_q$, q=1, . . . , Q, may thus be determined at a sampling point in time $t_0$ for the Q dryers 110. In an upcoming time period ($t_1-t_0$), the dryers 110 then must on average produce $P_D=\Sigma_{q=1}^{Q}p_qP_q$ heating power, wherein $P_q$ is the rated power of a dryer 110 and wherein $P_D$ is the average total power of the drying system 100.

Typically, it should be ensured that the mains connection of the drying system 100 may carry the average total power $P_D$, meaning that $P_D \leq U_{min}I_{Limit}=P_{Limit}$. On the other hand, given simultaneous activation of too large a number of dryers 110, situations might occur in which the required power exceeds the power limit $P_{Limit}$ or the current limit $I_{Limit}$ of the mains connection. Furthermore, an asymmetrical loading of half-waves in the supply grid might occur.

In an exemplary embodiment, the heating elements 112, 205 of the dryers 110 may therefore be activated or deactivated in a coordinated manner in an upcoming time period ($t_1-t_0$), such that:

- the respective activation degree $p_q$ is achieved for each dryers 110;
- the absolute value of the difference of the cumulative number $m_+=\Sigma_{q=1}^{Q}m_{+,q}$ of positive half-waves and the cumulative number $m_-=\Sigma_{q=1}^{Q}m_{-,q}$ of negative half-waves is minimized (to zero, or at most one). $m_{+,q}$ is thereby the number of positive half-waves at which the $q^{th}$ dryer 110 is active, and $m_{-,q}$ is thereby the number of negative half-waves at which the $q^{th}$ dryer 110 is active; and/or
- At no point in time is the instantaneous power limit $P_{Limit}$ or current limit $I_{Limit}$ exceeded. Assuming that all dryers 110 have substantially the same rated power $P_q$, the instantaneous power limit $P_{Limit}$ or current limit $I_{Limit}$ may be expressed as a maximum number $Q_{max}$ of dryers 110. It may thus be ensured that at no point in time (i.e. for no half-wave) are more than $Q_{max}$ of the Q dryers 110 activated.

In an exemplary embodiment, the condition of half-wave symmetry may, for example, be satisfied individually for each dryer 110. For this purpose, different activation patterns may be stored for different degrees of activation $p_q$, wherein an activation pattern is designed such that, within an upcoming planning time period ($t_1-t_0$), it applies that: $m_{+,q}=m_{-,q}$. FIG. 5 shows an example of a lookup table (LUT) 500 having different activation patterns 501, 502, 503 for different activation degrees $p_q$ within the planning time period 505. In particular, FIG. 5 shows an example of activation pattern 501 for an activation degree of 25%, an example of an activation pattern 502 for an activation degree of 50%, and an example of an activation pattern 503 for an activation degree of 75%. A checked square thereby indicates a half-wave in which the dryer 110 is activated, and a filled square shows a half-wave in which the dryer 110 is deactivated. The half-wave symmetry may be ensured in a resource-efficient manner via the use of a LUT 500.

The power limit or current limit may be complied with efficiently by taking into account the maximum number $Q_{max}$ of activated dryers 110. At the sampling point in time $t_0$, the activation degrees $p_q$ are determined for all Q dryers 110. The dryers 110 may then be divided up into a first group and a second group depending on the activation degrees $p_q$, such that the first group has $Q_1$ dryers 110 and the second group has $Q_2$ dryers 110, and such that $Q_1+Q_2/2 \leq Q_{max}$. The first group thereby typically comprises the dryers 110 with the relatively high degrees of activation $p_q$ (in particular with $p_q$>50%), and the second group typically comprises the dryers 110 with the relatively low degrees of activation $p_q$ (in particular with $p_q \leq 50\%$).

In an exemplary embodiment, the dryers 110 of the first group may be freely activated. On the other hand, the dryers 110 of the second group are divided up into two sub-groups of equal size and operated such that either the dryers 110 of the first sub-group or the dryers 110 of the second sub-group are activated at a point in time (i.e. for a half-wave). It may thus be efficiently ensured that the power limit or current limit of the mains connection are complied with.

In an exemplary embodiment, a defined, even number of heating elements 112, 205 that are distributed uniformly among all phases (meaning quantities that are divisible by 3) is limited to a maximum of 50% of activated half- or full waves with regard to a defined cycle time (i.e. to a defined planning time period 505). The activation signals for heating elements 112, 205 on the same phase (see FIG. 3*b*, 3*d*, 3*f*, for example) or for heating element triplets (see for example FIG. 3*a*, 3*c*, 3*e*) may alternately switch through a full wave. This may be done with at most so many heating elements 112, 205 that the allowable total power (i.e. power limit) is complied with. The required quantity of heating elements 112, 205 may be influenced by the configuration of the drying system 100 (in particular by the configuration of the available connection power), the voltage measurement (under/overvoltage), the current measurement per heating element 112, 205 (resistance tolerance) etc.

A drying system 100 for a printing system is thus described, in particular for an inkjet printing system. Furthermore, a printing system having a drying system 100 is described. The drying system 100 may comprise any of the features and/or components described in this document.

In an exemplary embodiment, the drying system 100 may comprise a plurality of dryers 110 that are arranged along a drying route 122 in order to dry a recording medium 122 upon traversing the drying route 122. The drying route 122 may, for example, be 1, 2, 3, 4 meters or more in length. Furthermore, the drying system 100 may comprise 10, 20, 30 or more dryers 110, for example. The plurality of dryers 110 may be supplied with an alternating current via at least two supply lines 201, 206 (in particular via the phase lines 201 and/or via the neutral line 206 of a multiphase supply grid), wherein the alternating current has a sequence of alternating positive and negative half-waves. The alternating current typically has a mains frequency of 50 Hz or 60 Hz, such that a time period of 1 second has 100 or 120 half-waves.

In an exemplary embodiment, the drying system 100 comprises controller 101 that is configured to couple the plurality of dryers 110 uniformly, on average, with the at least two supply lines 201, 206 given positive and negative half-waves depending on a nominal temperature curve 120 along the drying route 122. In other words, the controller 101 may activate or deactivate the dryers 110 intermittently (at different half-waves) in order to adjust (in particular to regulate) the temperature along the drying route 122 according to a predetermined nominal temperature curve 120. In an exemplary embodiment, the activation of the dryers 110 may thereby take place such that the positive and negative half-waves are substantially uniformly loaded. A reliable drying of a recording medium 102 may thus be produced given reduced loading of the supply grid.

In an exemplary embodiment, the controller 101 is configured to determine degrees of activation for the individual dryers 110 for an upcoming planning time period 505, based on the nominal temperature curve 120. The planning time period 505 may, for example, be 1 second, 0.5 seconds, 0.25 seconds or shorter. In an exemplary embodiment, the activation degree of a dryer 110 may indicate for how many half-waves the dryer 110 is to be coupled with the at least two supply lines 201, 206 in the upcoming planning time period 505, or for how many half-waves the dryer 110 is to be activated in the upcoming planning time period 505. In particular, the activation or the deactivation of a dryer 110 may take place synchronously with the supply grid so that an activation or deactivation of a dryer 110 takes place at a zero crossing of the alternating current (and thus without current). An energy-efficient switching of switching elements 204 (in particular power switches) to activate or deactivate the dryers 110 may thus be produced. A dryer 110 may then be activated or deactivated for an entire half-wave.

In an exemplary embodiment, the controller 101 is configured to couple the plurality of dryers 110 with the at least two supply lines 201, 206 (i.e. to activate them) in the upcoming planning time period 505, depending on the determined activation degrees. A reliable adjustment (in particular regulation) of the temperature at the recording medium 102 may thus be produced.

In an exemplary embodiment, the controller 101 may be configured to access a memory to determine a predefined activation pattern 501, 502, 503 for the dryer 110 for the upcoming planning time period 505, on the basis of the activation degree of a dryer 110. In an exemplary embodiment, different activation patterns 501, 502, 503 for different activation degrees may thereby be stored in the memory. The predefined activation patterns 501, 502, 503 may thereby indicate the positive and negative half-waves at which a dryer 110 is to be coupled (i.e. is to be activated) with the at least two supply lines 201, 206 in the upcoming planning time period 505. An especially efficient adjustment of the temperature at the recording medium 102 may be produced via the provision of predefined activation patterns 501, 502, 503.

In an exemplary embodiment, the predefined activation patterns 501, 502, 503 may thereby be designed such that the number of positive half-waves and the number of negative half-waves at which a dryer 110 is to be coupled (i.e. is to be activated) with the at least two supply lines 201, 206 in the upcoming planning time period 505 are identical. The half-wave symmetrical loading may thus be ensured efficiently overall for every single dryer 110, and thus also for the drying system 100.

In an exemplary embodiment, the drying system 100 comprises Q dryers 110 (for example Q≥10, 20 or 30). $p_q$, q=1, . . . , Q may be the degrees of activation of the Q dryers 110 for the upcoming planning time period 505. $P_q$ may thereby assume values between 0 (no activation in the planning time period 505) and 1 (continuous activation in the planning time period 505), for example. The upcoming planning time period 505 may thereby include $M_+$ positive half-waves and $M_-$ negative half-waves (for example given a mains frequency of 60 Hz and a planning time period 505 of 1 seconds, $M_+=50$ and $M_-=50$). $m_{+,q}$ may be the number of positive half-waves at which the $q^{th}$ dryer 110 is coupled (i.e. is activated) with the at least two supply lines 201, 206. $m_{-,q}$ may be the number of negative half-waves at which the $q^{th}$ dryer 110 is coupled (i.e. is activated) with the at least two supply lines 201, 206.

In an exemplary embodiment, the controller 101 is configured to couple (i.e. to activate) the Q dryers 110 with the at least two supply lines 201, 206 such that, in the upcoming planning time period 505, it applies that: $\Sigma_{q=1}^{Q} m_{-,q} = \Sigma_{q=1}^{Q} m_{+,q}$. Half-wave symmetry may thus be ensured across the Q dryers 110. The controller 101 may be additionally configured to couple (i.e. to activate) the Q dryers 110 with the at least two supply lines 201, 206 such that, for all=1, . . . , Q, it applies that:

$$\frac{m_{-,q} + m_{+,q}}{M_+ + M_-} = p_q.$$

A reliable adjustment of the temperature curve along the drying route 122 may thus be ensured.

In an exemplary embodiment, the drying system 100 includes a temperature sensor 116 that is configured to detect a real temperature at a point in an environment of the recording medium 102. In particular, Q temperature sensors 116 may be provided for the Q dryers 110. The controller 101 may be configured to determine a nominal temperature for the point in the environment of the recording medium 102. In particular, a nominal temperature may be determined for each dryer 110. In an exemplary embodiment, the activation degree for at least one dryer 110 may then be determined on the basis of the real temperature and/or on the basis of the nominal temperature (in particular on the basis of the difference between real temperature and nominal temperature). In particular, the differences between real temperature and nominal temperature may be determined for each dryer 110, and from this the activation degrees for the Q dryers 110 may be determined.

In an exemplary embodiment, the drying system 100 (in particular the mains connection of the drying system 100) has a power limit that indicates what power and/or what current may be drawn at maximum at a point in time (for example within a half-wave) via the mains connection of the dryers 110. In an exemplary embodiment, the controller 101 is configured to couple (i.e. to activate) the Q dryers 110 with the at least two supply lines 201, 206 such that the power limit is not exceeded in any half-wave of the upcoming planning time period 505.

For example, the power limit may be such that at most $Q_{max}$ dryers 110 may be coupled (i.e. activated) with the at least two supply lines 201, 206 in one half-wave. The controller 101 may be configured to assign $Q_1$ dryers 110 to a first group and $Q_2$ dryers 110 to a second group based on the activation degrees $P_q$ of the dryers 110, such that $Q_1+Q_2=Q$ and such that $Q_1+Q_2/2 \leq Q_{max}$. The dryers 110 with relatively high activation degrees may thereby be assigned to the first group, and the dryers 110 with relatively low activation degrees may thereby be assigned to the second group. The controller 101 may then activate the $Q_2$ dryers 110 such that at most $Q_2/2$ dryers 110 are coupled with the at least two supply lines 201, 206 in one half-wave. It may thus be efficiently ensured that the power limit of the drying system 100 is complied with without negatively affecting the drying efficiency of the drying system 100.

In an exemplary embodiment, a dryer 110 includes multiple resistive heating elements 112, 205 that are configured to generate thermal energy to dry the recording medium 102. The multiple resistive heating elements 112, 205 may thereby be arranged such that different phases 201 of a multiphase supply grid that comprises at least two supply lines 201, 206 are substantially uniformly loaded by the resistive heating elements 112, 205 of a dryer 110. The controller 101 may be set up either to jointly couple the resistive heating elements 112, 205 of the dryer 110 with the multiphase supply grid or jointly decouple the resistive heating elements 112, 205 of the dryer 110 from the multiphase supply grid during a half-wave. A symmetrical loading of the different phases of a multiphase supply grid may thus be efficiently ensured.

FIG. 4*b* shows a workflow diagram of a method 420 for drying a recording medium 102 according to an exemplary embodiment. The method 420 may include any additional features of the methods 410, 430 described in this document. The method 420 includes the guidance 421 of the recording medium 102 along a drying route 122, past a plurality of dryers 110, in order to dry the recording medium 122 upon traversal of the drying route 122. The plurality of dryers 110 may thereby be supplied with an alternating current having a sequence of positive and negative half-waves via at least two supply lines 201, 206. The method 420 additionally comprises the activation 422 of switching elements 204 depending on a nominal temperature curve 102 along the drying route 122 so that the plurality of dryers 110 is uniformly coupled with the at least two supply lines 201, 206 given positive and negative half-waves. During the operation of the drying system 100, the temperatures at the dryers 110 may thus be regulated such that a uniform loading of positive and negative half-waves of a supply grid takes place.

Given a drying or heating, the failure detection of the individual heating elements 112, 205 is important in order to ensure a reliable drying of a recording medium 102. The failure of a heating element 112, 205 may thereby occur with high resistance, such that the drying power is reduced, or occur as a short so that too much power or too high a temperature is introduced in part, or such that a fuse of the drying system 100 is triggered. If the failure of a heating element 112, 205 is detected (with a delay), this typically leads to a production failure (possibly with unusable print good) and to a standstill of the printing system. Within the scope of such an unplanned service break, the failure then must be localized, wherein the failure search may be relatively lengthy due to diverse failure causes (defect of the power activation, defect of a power switch 204, defect of a heating element 112, 205, defect of the wiring etc.).

Via a current measurement (e.g. using the current measurement meters 212) in the power supply, all (or some of the) heating elements 112, 206 may be activated sequentially or with a defined pattern upon startup of the printing system, before starting printing or in the operation of the printing system. The rated resistances and the tolerances of the individual heating elements 112, 205 are thereby typically known in advance. If the result of the current measurement coincides with the expected value, it may be concluded from this that a heating element 112, 205 (or, given pattern activation, a specific group of heating elements 112, 205) functions correctly. With an additional voltage measurement of at least one phase against N or against a second phase, the plausibility of the measurement value of the current together with the known resistance range of the heating elements 112, 205 may be verified.

The heating elements 112, 205 may be connected with one another in a different manner. As is depicted in FIGS. 3*a* and 3*b*, the heating elements 112, 205 may respectively be coupled on both sides to a power switch 204 (for example with a solid state relay (SSR)). A combined activation signal may thereby be used for all three heating elements 112, 205 (FIG. 3*a*), or separate activation signals (FIG. 3*b*) may be used. Alternatively, the heating elements 112, 205 may be coupled on one side with a power switch 204 and on the other side permanently with a phase 201 (FIGS. 3*c* and 3*d*). A combined activation signal may again be used for all three heating elements 112, 205 (FIG. 3*c*), or separate activation signals (FIG. 3*d*) may be used. Alternatively, the heating elements 112, 205 may be coupled on one side to a power switch 204 and on the other side to N 206 (FIGS. 3*e* and 3*f*). A combined activation signal may again be used for all three heating elements 112, 205 (FIG. 3*e*), or separate activation signals (FIG. 3*f*) may be used.

In an exemplary embodiment, if no current can be measured (and thus a high-resistance fault is present) in a test of a heating element 112, 205 or of a group of heating elements 112, 205, the following one or more causes may include, for example:

- A heating element 112, 205 is defective or a power switch 204 is defective; in particular, a precise detection is possible given the configurations from FIGS. 3*a* and 3*b*. Due to the current measurement at all three-phases L1, L2, L3, a differentiation may be made between a defective power switch 204 or a defective heating element 112, 205. If current flows in all three-phases L1, L2, L3, it may be concluded from this that a heating element 112, 205 is defective or not connected. If a phase has no current flow, it may be concluded from this that the corresponding power switch 204 is defective, or that a faulty connection with two defective heating elements 112, 205 is present.
- A conductor [line] is defective (for example line break, contact problem etc.). A subtle fault given increasing resistance, for example in the connection line, may be detected via a comparison of the measurement values at different points in time (trend analysis).
- An activation signal 214 is defective (conductor, assembly etc.). Given configuration with combined activation signals 214 (as depicted in FIG. 3*a*, 3*c*, 3*e*), this may in particular be diagnosed via the simultaneous failure of three heating elements 112, 205 (due to the relatively low probability of such a triple fault). Given configuration with separate activation signals (as depicted in FIG. 3*b*, 3*d*, 3*f*), a defective activation line 214 typically cannot be differentiated from a defective power switch 204 or a defective heating element line. To assist in diagnosis, an LED indicator given an active activation signal or a signal feedback/monitoring may be provided, for example.
- The current measurement is defective. For example, this may be detected via a plausibility verification via temperature measurement and measurement of multiple heating elements 112, 205.

Given presence of a low-resistance fault or short, a defective power switch 204 or a defective heating element 112, 205 may in particular be present.

Given the configuration depicted in FIG. 3*a*, a defective power switch 204 is insufficient to generate a current flow. The current circuit is only closed upon activation of a second power switch 204. Since only a common activation signal for three heating elements 112, 205 is available, a defective power switch 204 thus typically may not be detected directly. However, the voltage may be measured after the individual power switches 204 for evaluation. Given intact power switches 204, a virtual neutral point results. If a power switch 204 is defective, the voltage increases to the supply level after the individual power switches 204. On the other hand, if too high a current flows with the activation signal, at least one heating element 112, 205 or the path after a power switch 204 has low resistance. In such an instance, the fuse 203 possibly triggers, or the activation signal must be deactivated. The fault location may be indicated via the current measurement or via the currently activated triplet of heating elements 112, 205.

In the configuration from FIG. 3*b*, a defective power switch 204 is insufficient to generate a current flow. The current circuit is only closed upon activation of a second power switch 204. Since an activation signal 214 is provided for each power switch 204, the failure of a power switch 204 may be localized via sequential activation of the power switches 204. If too high a current flows with the activation signal, it may be concluded from this that a heating element 112, 205 or the path after a power switch 204 is of low resistance. In such an instance, the fuse 203 possibly triggers, or the activation signal must be deactivated. The fault location may be indicated via the current measurement or via the currently activated power switch 204.

In the configuration from FIG. 3*c*, 3*d*, 3*e*, 3*f*, a current flow without activation signal 214 is an indication that a power switch 204 is defective (for example a SSR has become shorted). The drying system 100 should react with an emergency shutdown. If too high a current flows with the activation signal, this is an indication that a heating element 112, 205 or the path after a power switch 204 is of low resistance. The fuse 203 may thereby possibly trigger, or the activation signal must possibly be deactivated. The fault location may be indicated via the current measurement or via the one or more currently activated power switches 204.

For the configurations depicted in FIG. 3*a* through 3*f*, a subtle fault given decreasing resistance (for example given contamination) may be detected via comparison of the measurement values at different successive points in time (trend analysis).

A fault detected using the current measurement may be isolated for a service technician so that the time required for the fault search, and therefore the production downtime of the printing system, may be reduced. In particular, it may be indicated in which dryer 110, at which heating element 112, 205, at which power switch 204 etc. a fault is present.

The measures described above for detection of a fault may be used for an upcoming service and/or for a power compensation. For example, if a heating element 112, 205 is defective, the time until the service may be bridged by an emergency operation, for example via a reduced print speed, via a longer heat-up time, or via similar measures. Given the configuration from FIG. 3*c*-3*f*, for this purpose the associated power protection switch 203 may be deactivated in the event of a short circuit or a defective power switch 204. Given the configurations from FIGS. 3*d* and 3*f*, the defect of an activation signal is thereby typically less critical since all other heating elements 112, 205 may continue to be used independently of one another expect for the heating element 112, 205 that cannot be activated. In the configuration from FIG. 3*b*, the defect of an activation signal leads to a reduced total power on two phases. For example, a defect of the current measurement (for example of a phase) or a defect of the voltage measurement may be compensated in that the current values of the heating elements 112, 205 as well as the value of the voltage are stored cyclically.

A power compensation may in particular take place given an overdimensioning of the dry 100. If the heating elements 112, 205 are designed so that the rated power is achieved given undervoltage $U_{min}$ and maximum resistance $R_{max}$, the possibility exists to compensate for both low-resistance and high-resistance failures via the available surplus power of adjacent heating elements 112, 205.

It is noted that a current measurement of every single heating element 112, 205 may possibly take place. Alternatively or additionally, a voltage measurement may take place for every single heating element 112, 205.

According to exemplary embodiments, the current measurement together with a defined activation procedure of the heating elements 112, 205 enables a fault detection. The fault possibilities and the fault location may thus be localized so that service tasks may be accelerated. The productivity of a printing system may thus be increased. With a voltage measurement, an expected value of the current measurement may be calculated in advance, with which the precision of the check may be increased. Furthermore, subtle faults may be detected. Moreover, the possibility exists to implement service activities as planned and to compensate for faults such that production may be continued without or with only slight capacity limitation.

A drying system 100 for a printing system is thus described, in particular for an inkjet printing system. Furthermore, a printing system having a drying system 100 is described. The drying system 100 may comprise any of the features and/or components described in this document.

In particular, the drying system 100 may comprise a plurality of heating elements 112, 205 that are configured to generate thermal energy for drying a recording medium 102. The plurality of heating elements 112, 205 may thereby be supplied with electrical power via at least two supply lines 201, 206.

In an exemplary embodiment, the drying system 100 may additionally comprise a current measurement meter 212 that is configured to detect current flowing via one or more of the supply lines 201, 206. Moreover, the drying system 100 may comprise switching elements 204 that are configured to couple different subsets of the plurality of heating elements 112, 205 with the supply lines 201, 206 (so that a current may flow across the subset of heating elements 112, 205).

In an exemplary embodiment, the drying system 100 comprises controller 101 that is configured to activate the switching elements 204 in order to couple different subsets of heating elements 112, 205 from the plurality of heating elements 112, 205 with the supply lines 201, 206, and in order to thereby determine subset currents across the different subsets of heating elements 112, 205 by means of the current measurement meter 212. In particular, different subsets of heating elements 112, 205 may be sequentially (i.e. successively) coupled with the supply lines 201, 206.

In an exemplary embodiment, the controller 101 may then detect a defect in the drying system 100, in particular in a subset of heating elements 112, 205 and/or in a switching element 204, on the basis of the subset currents. In particular, it may be determined whether a subset current across a subset of heating elements 112, 205 is greater than or equal to a low-resistance threshold (and thus possibly that a short is present). Furthermore, it may be determined whether a subset current across a subset of heating elements 112, 205 is less than or equal to a high-resistance threshold (and thus possibly that a high-resistance defect is present). The controller may then determine a type of defect in the drying system 100 depending on the comparisons. Moreover, a defect may typically be localized via the determination of subset currents.

In an exemplary embodiment, the controller 101 may be configured to access a memory in order to determine resistances of the plurality of heating elements 112, 205. The drying system 100 may comprise a voltage measurement meter 202 that is configured to determine a voltage present at the at least two supply lines 201, 206. A defect may then (possibly also) be detected on the basis of the resistances of the heating elements 112, 205 and on the basis of the voltage. In particular, a nominal subset current across the subset of heating elements 112, 205 may be determined on the basis of the resistances of a subset of heating elements 112, 205 and on the basis of the voltage. The nominal subset current may then be compared with the determined subset current across the subset of heating elements 112, 205 in order to detect a defect in the drying system 100. The reliability and the precision of the defect detection may thus be further increased.

In an exemplary embodiment, the controller 101 is configured to determine the subset current across a subset of heating elements 112, 205 at a first point in time and at a subsequent second point in time. The subset currents at the first point in time and at the second point in time may then be compared in order to detect a defect in the drying system 100. For example, subtle defects may thus be detected.

In an exemplary embodiment, the drying system 100 includes multiple dryers 110 that are arranged along a drying route 122 to dry the recording medium 102 upon traversal of the drying route 122, wherein each of the dryers 110 comprises one or more of the plurality of heating elements 112, 205. The controller 101 may be configured to activate the switching elements 204 such that a subset of heating elements 112, 205 exclusively comprises heating elements 112, 205 from a dryer 110. The localization of a defect may thus be improved.

In an exemplary embodiment, the controller 101 is configured to activate the switching elements 204 in order to regulate the thermal energy generated by the plurality of heating elements 112, 205. Within the scope of the regulation, a detected defective subset of heating elements 112, 205 may thereby be at least partially compensated. In particular, a detected defective subset of heating elements 112, 205 may remain unconsidered (i.e. deactivated) in the regulation, and the required thermal energy may be produced at least in part by one or more other heating elements 112, 205. A flexible remediation of defects (at a later point in time) is thus enabled.

The plurality of heating elements 112, 205 may comprise three heating elements 112, 205, and the switching elements 204 may comprise three switching elements 204 in order to couple the three heating elements 112, 205 with three-phase lines 201 and/or with a neutral line 206 of a three-phase supply grid. The three switching elements 204 may possibly be activated by a common control signal 214.

In an exemplary embodiment, the three heating elements 112, 205 may be arranged such that both sides of a heating element 112, 205 are connected via switching elements 204 with the three-phase supply grid. Alternatively, in a second embodiment or third embodiment, the three heating elements 112, 205 may alternatively be arranged such that one side of a heating element 112, 205 is directly connected with a phase line 201 or with a neutral line 206 of the three-phase supply grid and such that another side of the heating element 112, 205 is connected via a switching element 204 with a phase line 201 of the three-phase supply grid.

FIG. 4*c* shows a workflow diagram of a method 430 for detection of a defect of a drying system 100 according to an exemplary embodiment. The method 430 may comprise any features of the method 410, 420 described in this document.

In an exemplary embodiment, the method 430 includes the activation 431 of the switching elements 204 of the drying system 100 in order to (possibly sequentially) couple different subsets of heating elements 112, 205 of the plurality of heating elements 112, 205 with the supply lines 201, 206, and in order to thereby determine subset currents across the different subsets of heating elements 112, 205 by means of the current measurement meter 212. Moreover, the method 430 comprises the detection 432, on the basis of the subset currents, of a defect in the drying system 100, in particular in a subset of heating elements 112, 205 and/or in a switching element 204. The current through the individual heating elements 112, 205 may thus be sequentially measured by a current measurement meter 212, and a defect in the drying system 100 may be detected based on this.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc.

Further, any of the implementation variations may be carried out by a general purpose computer.

For the purposes of this discussion, "processor circuitry" can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

100 dryer
101 controller
102 recording medium
110 drying module
111 control module
112 heating element
113 nozzle
114 tempered drying medium
115 blower
116 temperature sensor
120 temperature curve
122 drying route
126 temperature
201 phase power
202 voltage measurement meter
203 power protection switch
204 power switch/switching element
205 heating resistor
206 neutral line
212 current measurement meter
214 control line
410 method to dry a recording medium
411, 412 method steps
420 method to dry a recording medium
421, 422 method steps
430 method to detect a defect of a dryer
431, 432 method steps
500 lookup table for activation patterns
501, 502, 503 activation patterns
505 planning time period

The invention claimed is:

1. A drying system for a printing system, wherein the drying system comprises:

a plurality of dryers that are arranged along a drying route to dry a recording medium upon traversal of the drying route by the recording medium, each of the plurality of dryers including multiple resistive heating elements that are configured to generate thermal energy to dry the recording medium, the multiple resistive heating elements being arranged such that different phases of a multiphase supply grid having at least two supply lines is substantially uniformly loaded by the resistive heating elements of a corresponding one of the plurality of dryers, wherein the plurality of dryers are supplied via the at least two supply lines with an alternating current having a sequence of alternating positive and negative half-waves; and a controller coupled to the plurality of dryers and configured to:

couple the plurality of dryers uniformly on average with the at least two supply lines given positive and negative half-waves based on a nominal temperature curve along the drying route; and jointly couple the resistive heating elements of a corresponding dryer of the plurality of dryers with the multiphase supply grid or jointly decouple the resistive heating elements of the dryer of the plurality of dryers with the multiphase supply grid during a half-wave.

2. The drying system according to claim 1, wherein the controller is further configured to:

determine degrees of activation for individual dryers of the plurality of dryers for an upcoming planning time period based on a nominal temperature curve, the degree of activation of a corresponding one of the plurality of dyers indicating for how many half-waves the corresponding dryer is to be coupled with the at least two supply lines in the upcoming planning time period; and couple the plurality of dryers with the at least two supply lines in the upcoming planning time period based on the determined degrees of activation.

3. The drying system according to claim 2, wherein:

the controller is further configured to access a memory to determine a predefined activation pattern for a dryer of the plurality of dyers for the upcoming planning time period based on the degree of activation of the dryer of the plurality of dryers;

the predefined activation pattern indicates positive and negative half-waves at which the dryer of the plurality of dryers is to be coupled with the at least two supply lines in the upcoming planning time period; and the predefined activation pattern is configured such that a number of positive half-waves and a number of negative half-waves at which the dryer of the plurality of dryers is to be coupled with the at least two supply lines in the upcoming planning time period are identical.

4. The drying system according to claim 3, wherein the memory is configured to store different activation patterns for different degrees of activation.

5. The drying system according to claim 3, wherein:

the drying system comprises Q dryers of the plurality of dryers;

$p_q$, q=1, . . . , Q is the degree of activation of the Q dryers for the upcoming planning time period;

the upcoming planning time period includes $M_+$ positive half-waves and M_0 negative half waves;

$m_{+,q}$ is a number of positive half-waves at which the $q^{th}$ dryer of the Q dryers is coupled with the at least two supply lines;

$m_{-,q}$ is a number of negative half-waves at which the $q^{th}$ dryer of the Q dryers is coupled with the at least two supply lines; and the controller is configured to couple the Q dryers with the at least two supply lines such that, in the upcoming planning time period, it applies that: $\Sigma_{q=1}^{Q} m_{-,q} = \Sigma_{q=1}^{Q} m_{+,q}$, and that it applies for all q=1, . . . , Q that:

$$\frac{m_{-,q} + m_{+,q}}{M_+ + M_-} = p_q.$$

6. The drying system according to claim 2, wherein:

the drying system comprises Q dryers of the plurality of dryers;

$p_q$, q=1, . . . , Q is the degree of activation of the Q dryers for the upcoming planning time period;

the upcoming planning time period includes $M_+$ positive half-waves and M_ negative half waves;

$m_{+,q}$ is a number of positive half-waves at which the $q^{th}$ dryer of the Q dryers is coupled with the at least two supply lines;

$m_{-,q}$ is a number of negative half-waves at which the $q^{th}$ dryer of the Q dryers is coupled with the at least two supply lines; and the controller is configured to couple the Q dryers with the at least two supply lines such that, in the upcoming planning time period, it applies that: $\Sigma_{q=1}^{Q} m_{-,q} = \Sigma_{q=1}^{Q} m_{+,q}$, and that it applies for all q=1, . . . , Q that:

$$\frac{m_{-,q} + m_{+,q}}{M_+ + M_-} = p_q.$$

7. The drying system according to claim 2, further comprising a temperature sensor that is configured to detect a temperature at a point in an environment of the recording medium, wherein the controller is configured to:

determine a nominal temperature for the point in the environment of the recording medium based on the nominal temperature curve; and determine the degree of activation for at least one dryer of the plurality of dryers based on the detected temperature and the determined nominal temperature.

8. The drying system according to claim 2, wherein:

the drying system comprises Q dryers of the plurality of dryers;

the drying system has a power limit that indicates what power and/or what current may be drawn at maximum at one point in time via a main connection of the drying system; and the controller is configured to couple the Q dryers with the at least two supply lines such that in no half-wave of the upcoming planning time period is the power limit exceeded.

9. The drying system according to claim 8, wherein:

$p_q$, q=1, . . . , Q is the degree of activation of the Q dryers for the upcoming planning time period;

the power limit is such that a maximum of $Q_{max}$ dryers of the Q dryers may be coupled with the at least two supply lines in a half-wave; and the controller is further configured to:

assign $Q_1$ dryers of the Q dryers with a first group and $Q_2$ dryers of the Q dryers with a second group based on the degrees of activation $p_q$, such that $Q_1+Q_2=Q$ and such that $Q_1+Q_2/2 \leq Q_{max}$; and activate the $Q_2$ dryers such that at most $Q_2/2$ dryers are coupled with the at least two supply lines in a half-wave.

10. A method for drying a recording medium, comprising:

guiding the recording medium along a drying route past a plurality of dryers to dry the recording medium upon traversal of the drying route, each of the plurality of dryers including multiple resistive heating elements that are configured to generate thermal energy to dry the recording medium, the multiple resistive heating elements being arranged such that different phases of a multiphase supply grid including at least two supply lines is substantially uniformly loaded by the resistive heating elements of a corresponding one of the plurality of dryers, wherein the plurality of dryers are supplied with an alternating current having a sequence of positive and negative half-waves via the at least two supply lines; and activating switching elements based on a nominal temperature curve along the drying route so that:

the plurality of dryers are, on average, uniformly coupled with the at least two supply lines given positive and negative half-waves, and the resistive heating elements of a drying module are jointly coupled with the multiphase supply grid or jointly decoupled from the multiphase supply grid during a half-wave.

11. A printing system including the drying system, the drying system having the plurality of dryers and a controller, wherein the controller is configured to perform the method of claim 10.

12. A non-transitory computer-readable storage medium with an executable program stored thereon, wherein, when executed, the program instructs a processor to perform the method of claim 10.

13. A method for drying a recording medium, comprising:

guiding the recording medium along a drying route past a plurality of dryers to dry the recording medium, the plurality of dryers being supplied with an alternating current having a sequence of positive and negative half-waves via supply lines of a power supply; and activating switching elements based on a temperature along the drying route to selective couple the plurality of dryers with the power supply, wherein, during a half wave, the plurality of dryers are either jointly coupled with or decoupled from the power supply.

14. The method according to claim 13, wherein the plurality of dryers each comprise a one or more resistive heating elements configured to generate thermal energy based on the supplied alternative current.

15. A printing system including the drying system, the drying system having the plurality of dryers and a controller, wherein the controller is configured to perform the method of claim 13.

16. A non-transitory computer-readable storage medium with an executable program stored thereon, wherein, when executed, the program instructs a processor to perform the method of claim 13.

* * * * *